US011064852B2

(12) United States Patent
Wood

(10) Patent No.: US 11,064,852 B2
(45) Date of Patent: Jul. 20, 2021

(54) IMPLEMENT HEAD CLEANING SYSTEM

(71) Applicant: NoCo Tech, LLC, Fort Collins, CO (US)

(72) Inventor: Steven Wood, Fort Collins, CO (US)

(73) Assignee: NoCo Tech, LLC, Fort Collins, CO (US)

( * ) Notice: Subject to any disclaimer, the term of this patent is extended or adjusted under 35 U.S.C. 154(b) by 237 days.

(21) Appl. No.: 15/785,192

(22) Filed: Oct. 16, 2017

(65) Prior Publication Data

US 2018/0035855 A1 Feb. 8, 2018

Related U.S. Application Data

(63) Continuation of application No. 15/159,661, filed on May 19, 2016, now Pat. No. 9,788,695.

(60) Provisional application No. 62/164,886, filed on May 21, 2015.

(51) Int. Cl.

| | |
|---|---|
| ***A47L 7/00*** | (2006.01) |
| ***B08B 5/04*** | (2006.01) |
| ***A47L 9/28*** | (2006.01) |

(52) U.S. Cl.

CPC ..... *A47L 7/00* (2013.01); *A47L 7/0057* (2013.01); *A47L 9/2842* (2013.01); *B08B 5/04* (2013.01)

(58) Field of Classification Search

CPC ..... A47L 7/0057; A47L 23/263; A47L 23/22; A47L 23/24; A47L 13/502; A47L 5/38; B60S 3/042; B66C 1/02; B66C 1/0212; B66C 1/0281; B66C 1/0287;

(Continued)

(56) References Cited

U.S. PATENT DOCUMENTS 1,347,236 A * 7/1920 Underwood ..... A47L 5/38 137/360

1,572,102 A 2/1926 Braunsdorf (Continued)

FOREIGN PATENT DOCUMENTS

| | | | | |
|---|---|---|---|---|
| CA | 2657828 A1 | | 9/2010 | |
| DE | 27 22 110 A1 | | 11/1978 | |
| WO | WO-2013147502 A1 | * | 10/2013 | ..... A47L 23/22 |

OTHER PUBLICATIONS

Corresponding European Patent Application No. 16797361.9; Office Action dated Feb. 25, 2019, 9 pages.

(Continued)

*Primary Examiner* — Orlando E Aviles
*Assistant Examiner* — Joel D Crandall
(74) *Attorney, Agent, or Firm* — Craig R. Miles; CR Miles P.C.

(57) ABSTRACT

An implement head cleaning system which includes apparatuses and methods of cleaning an implement head. An implement head cleaner including an implement head cleaning base having a base bottom configured for placement on a support surface and having an air flow chamber disposed in a base top covered by an air flow inlet plate which directs an air flow through one or more air inlet aperture elements to egress through an air outlet toward an air flow generator. Materials entrained in material entrainment elements carried by the implement head can be removed by moving the material entrainment elements over the air flow inlet plate through the air flow.

21 Claims, 11 Drawing Sheets

(58) Field of Classification Search
CPC ..... B66C 1/0293; H01L 21/6838; Y10T 29/53191; B25B 11/005
See application file for complete search history.

(56) References Cited

U.S. PATENT DOCUMENTS

| | | | | |
|---|---|---|---|---|
| 1,898,887 | A * | 2/1933 | Naul | A47L 13/502 15/142 |
| 2,159,176 | A * | 5/1939 | Nelson | A47L 13/502 15/142 |
| 2,247,549 | A | 7/1941 | Frederick | |
| 2,681,466 | A | 6/1954 | Nelson | |
| 3,056,993 | A | 10/1962 | Lewis | |
| 3,531,818 | A | 10/1970 | Gardner et al. | |
| 6,041,470 | A | 3/2000 | Branham et al. | |
| 9,788,695 | B2 | 10/2017 | Wood | |
| 2004/0088814 | A1* | 5/2004 | Hsieh | A47L 5/38 15/310 |
| 2007/0086868 | A1* | 4/2007 | Ray | B23Q 9/0014 408/76 |
| 2007/0204427 | A1* | 9/2007 | Cho | A47L 9/0072 15/387 |
| 2008/0295278 | A1 | 12/2008 | Pelletier | |

OTHER PUBLICATIONS

U.S. Appl. No. 62/164,886, filed May 21, 2015.
PCT International Patent Application No. PCT/US16/33449; International Search Report and Written Opinion of the International Searching Authority, dated Aug. 18, 2016.

* cited by examiner 33
53
40
32
37
38
31
41/48
39
51
46
50/65
44/47/49
13/14
69
71
34A
69B/70
34
36
34B
69A/70
64
66
67
6
8
10
11
7
5
15/16
24
25
24/29
3
2
63
19
4
61
60
9
17A
17B
12
17C
30
18
1

IMPLEMENT HEAD CLEANING SYSTEM

This United States patent application is a continuation of U.S. patent application Ser. No. 15/159,661, filed May 19, 2016, now U.S. Pat. No. 9,788,695, issued Oct. 17, 2017, which claims the benefit of U.S. Provisional Patent Application No. 62/164,886, filed May 21, 2015, each hereby incorporated by reference herein.

I. TECHNICAL FIELD

An implement head cleaning system which includes apparatuses and methods of cleaning an implement head. An implement head cleaner including an implement head cleaning base having a base bottom configured for placement on a support surface and having an air flow chamber disposed in a base top covered by an air flow inlet plate which directs an air flow through one or more air inlet aperture elements to egress through an air flow outlet toward an air flow generator. Materials entrained in material entrainment elements carried by the implement head can be removed by moving the material entrainment elements over the air flow inlet plate through the air flow.

II. BACKGROUND

Typically, mop and broom heads are shook, struck, or vacuumed to remove material entrained by the yarn, bristles, fibers, microfiber sheet, or sponges carried by the mop or broom head. Shaking or striking a mop or broom head disperses removed materials into the surrounding air. The dispersed materials can be inhaled or are deposited on surrounding surfaces which must then be again cleaned. Vacuuming the mop or broom head involves engagement of a vacuum hose to the mop or broom head. The vacuum hose or vacuum hose attachments may not be configured to readily clean the configuration of a mop or broom head, and additionally, the mop or broom head and the vacuum hose must be engaged in a manner discrete from the normal operational movements of the mop or broom.

III. SUMMARY OF THE INVENTION

Accordingly, a broad object of the invention can be to provide an implement head cleaner including one or more of an implement head cleaning base having a vacuum chamber disposed in a base bottom configured for sealable engagement with a support surface and having an air flow chamber disposed in a base top covered by an air flow inlet plate configured to engage the material entrainment elements carried by an implement head with an air flow to remove material entrained by the material entrainment elements.

Another broad object of the invention can be a method of making an implement head cleaner including one or more of: disposing an air flow chamber in a base, the base having a base top and a base bottom, and the air flow chamber having an air flow chamber closed end disposed at a depth in the base and an air flow open end communicating with the base top, and removably engaging an air flow inlet plate with the base top to cover the air flow chamber open end, the air flow inlet plate having a plurality of air flow inlet apertures through which an air flow enters the air flow chamber; and disposing a vacuum chamber in the base bottom, the vacuum chamber having a vacuum chamber closed end disposed at depth in the base and a vacuum chamber open end communicating with the base bottom and coupling an air flow outlet element to the base, the air flow outlet element having an internal surface which defines an air flow outlet passage fluidicly coupled to the air flow chamber and to the vacuum chamber, and the air flow outlet having an external surface configured to couple to an air flow generator.

Another broad object of the invention can be a method of using an implement head cleaner including: obtaining an implement head cleaner having one or more of: a base having an air flow chamber disposed in a base top and a vacuum chamber disposed in a base bottom configured for placement on a support surface, and an air flow inlet plate coupled to the air flow chamber configured to engage an air flow with material entrainment elements carried by an implement head, and by placing the base bottom on a support surface, and, by fluidicly coupling an air flow generator to the air flow chamber and the vacuum chamber, an air flow can be drawn through the air flow inlet plate for engagement with the material entrainment elements carried by an implement head and from the vacuum chamber to generate a vacuum to fix location or reduce movement of the implement head cleaning base in relation to a support surface.

Another broad object of the invention can be to provide a method of removing entrained materials from the material entrainment elements carried by an implement head of an implement including moving the material entrainment elements over an air flow inlet plate coupled to an air flow chamber disposed in a base top of a base placed on a support surface; and displacing materials entrained in the material entrainment elements into the air flow.

Naturally, further objects of the invention are disclosed throughout other areas of the specification, drawings, photographs, and claims.

IV. A BRIEF DESCRIPTION OF THE DRAWINGS

V. DETAILED DESCRIPTION OF THE PREFERRED EMBODIMENTS

Figure 1:
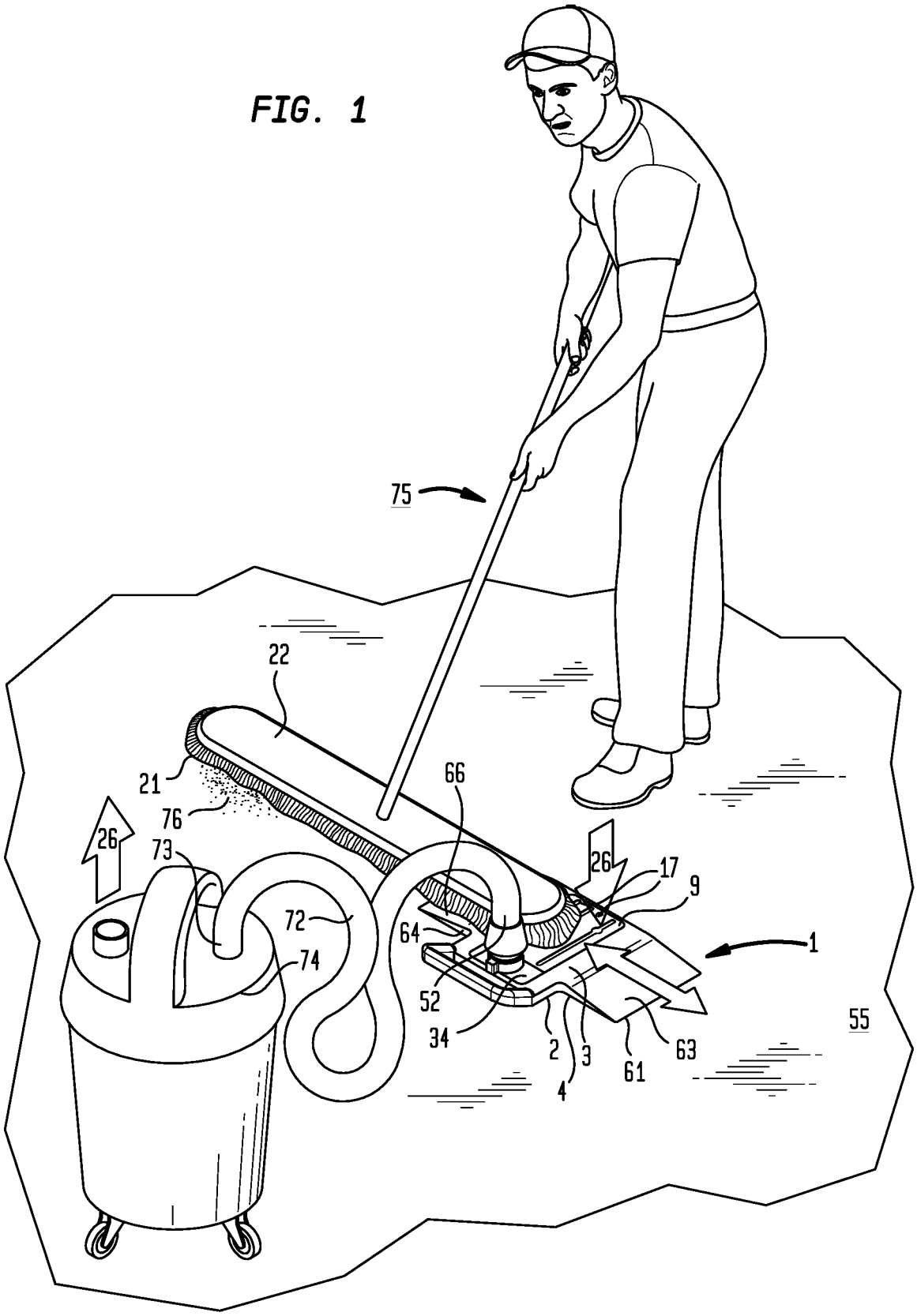
FIG. 1 is an illustration of a method of using an embodiment of the inventive implement head cleaner.
Figure 2:
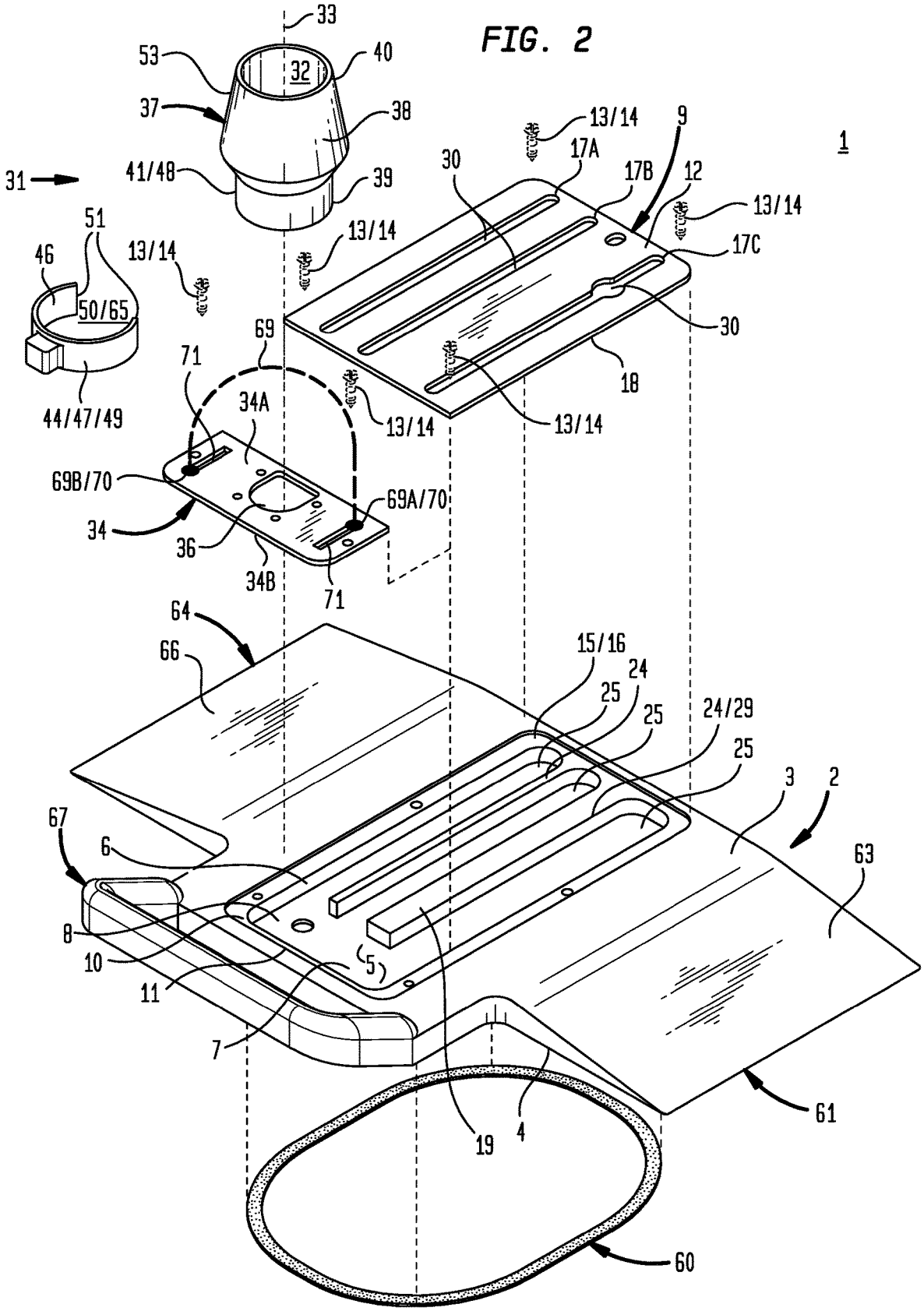
FIG. 2 is an exploded view of an embodiment of the inventive implement head cleaner.
Figure 4:
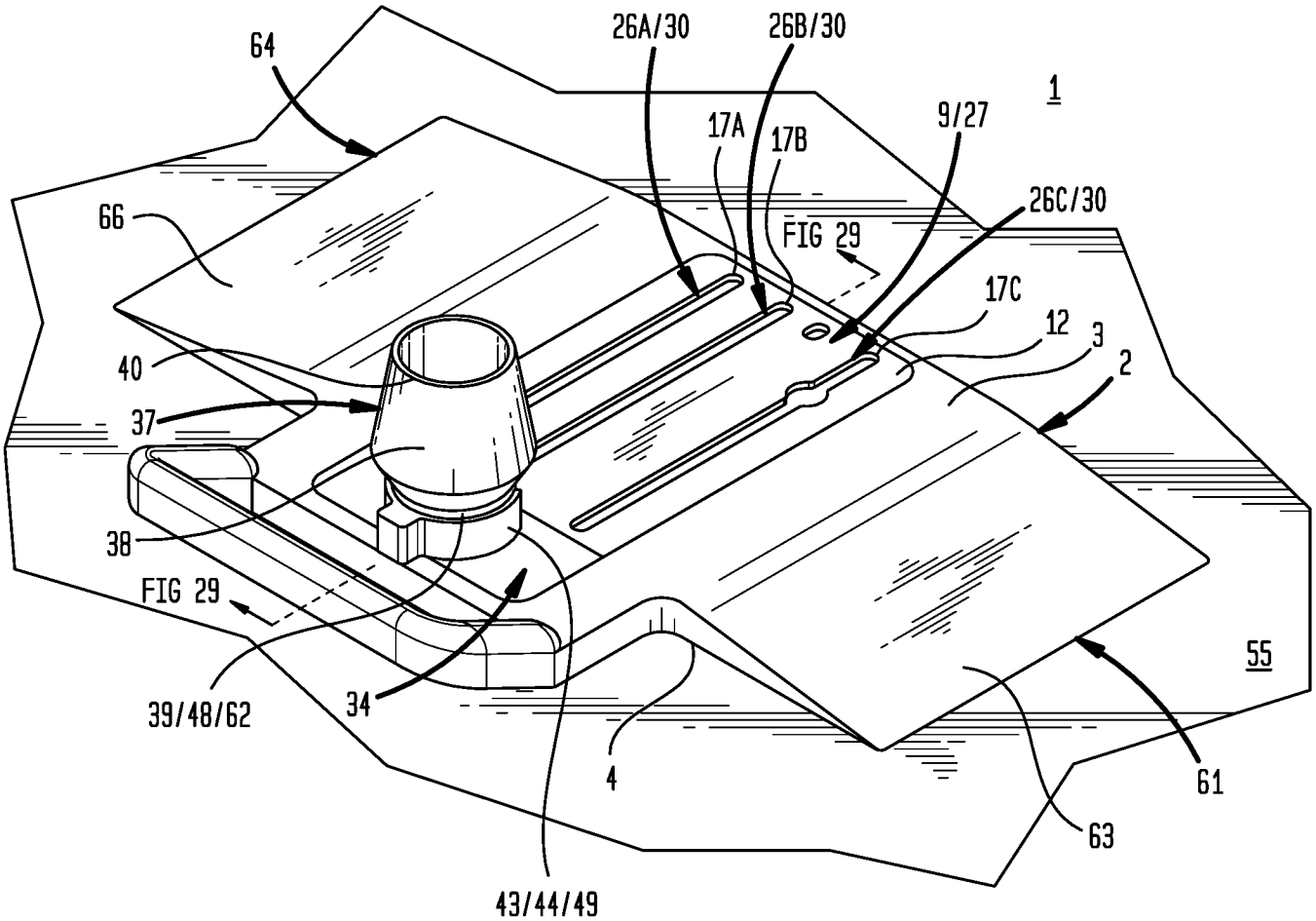
FIG. 4 is a perspective view of an embodiment of the implement head cleaner having the air flow inlet plate coupled to an air flow chamber in a first air flow orientation.
Figure 5:
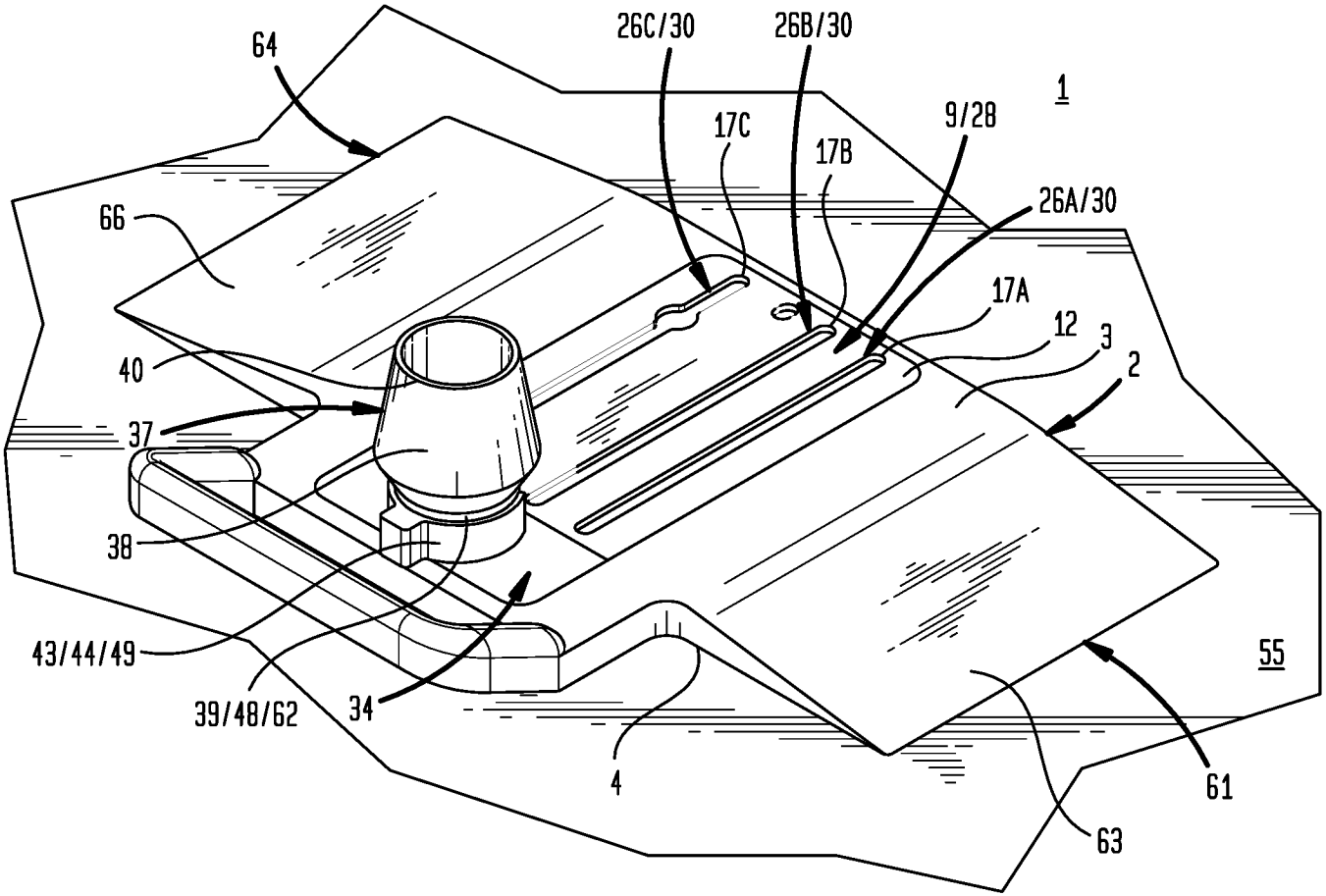
FIG. 5 is a perspective view of an embodiment of the inventive implement head cleaner having the air flow inlet plate coupled to the air flow chamber in a second airflow orientation of air flow inlet aperture elements.
Figure 6:
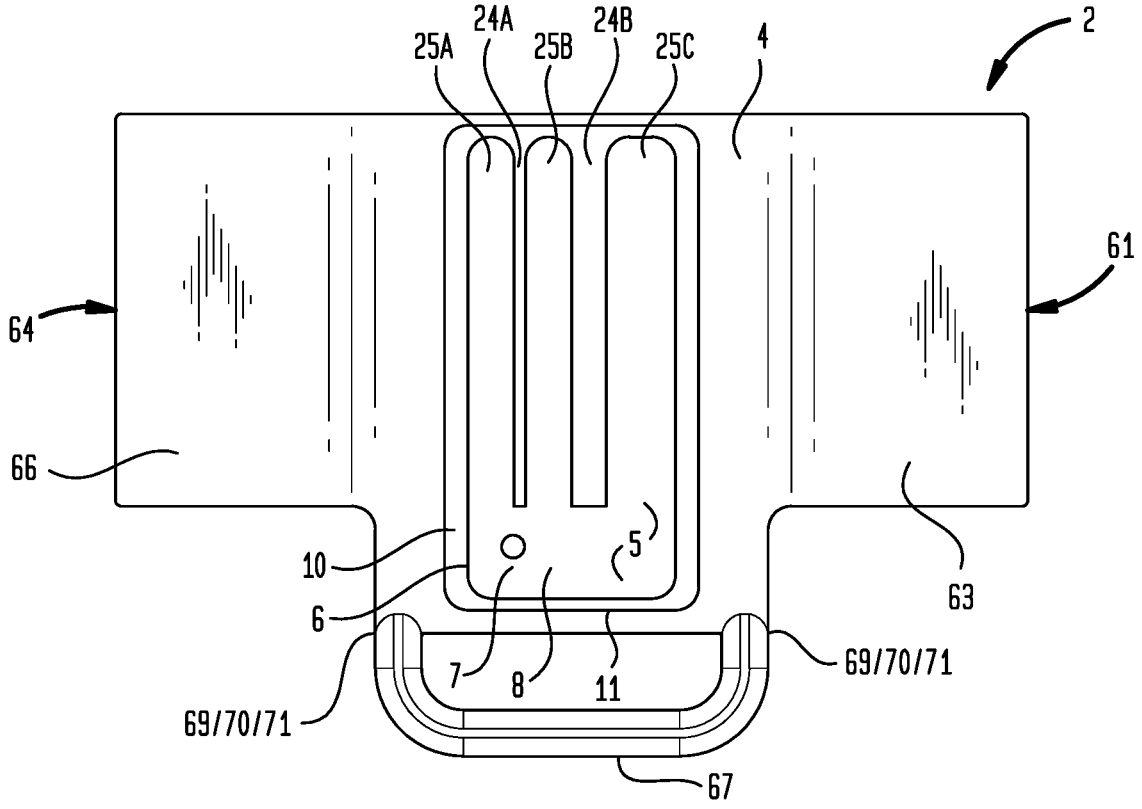
FIG. 6 is a top view of an embodiment of the implement head cleaner base without the air flow inlet plate, showing the air flow chamber divided into discrete air flow compartments having a configuration which allows the air flow inlet plate to be disposed in either the first air flow orientation or second air flow orientation as shown in FIGS. 4 and 5.

Now referring primarily to FIGS. 1 through 6, particular embodiments of the implement head cleaner (1) include a base (2) having a base top (3) disposed opposite a base bottom (4). As shown in FIGS. 2 and 6, the air flow chamber (5) can include an air flow chamber side wall (6) connected between an air flow chamber bottom (7) and the base top (3) defining an air flow chamber opening (8) in the base top (3). An air flow inlet plate (9) can, but need not necessarily, be coupled to the base top (3) to cover the air flow chamber opening (8). As to particular embodiments, a recessed shoulder (10) can, but need not necessarily, be disposed in the base top (3) about the air flow chamber periphery (11) to support and laterally secure placement of the air flow inlet plate (9) in relation to the air flow chamber (5). The depth of the recessed shoulder (10) can be sufficient to dispose the air flow inlet plate top (12) surface flush or substantially flush with the base top (3). As to particular embodiments, one or more fasteners (13) can, but need not necessarily, secure placement of the air flow inlet plate (9) in relation to the base top (3) or in the recessed shoulder (10). The one or more fasteners (13) can, but need not necessarily, include mechanical fasteners (14)(as shown in the example of FIG. 2 in broken line) such as bolts, screws, or the like, or as to certain embodiments, the one or more fasteners can include one or more magnetic elements (15) secured to the base top (3) or recessed shoulder (10)(as shown in the example of FIG. 2), which can magnetically secure the air flow inlet plate (9), which can be of a ferromagnetic material which magnetically secures to the magnetic elements (15). As to particular embodiments, the one or more magnetic elements (15) can, but need not necessarily, be in the form of a magnetic tape (16) secured to the recessed shoulder (10) by fasteners or adhesive to allow releasable magnetic securement of a metallic air flow inlet plate (9) in relation to the air flow chamber opening (8).

Now referring primarily to FIGS. 2 through 5, 12 and 13, the air flow inlet plate (8) can have one or more air flow inlet aperture elements (17) which communicate between an air flow inlet plate top (12) opposite an air flow inlet plate bottom (18) of the air flow inlet plate (8). While the embodiment of the air flow inlet plate (9) shown in the Figures includes air flow inlet aperture elements (16) configured as a first, second and third substantially linear elongate air intake slots (17A)(17B)(17C) disposed in substantially parallel spaced apart relation in the air flow inlet plate, this is not intended to exclude embodiments of the air flow inlet plate (8) having a plurality of air flow inlet aperture elements (17) otherwise configured. These configurations, for example, may be air flow inlet aperture elements (17) having an air flow inlet open area (10) defined by an aperture perimeter configured as: a rectangle, a square, a triangle, a star or as a polygon, a circle, an oval, an ellipse, or other perimeter configuration or combinations thereof.

Now referring primarily to FIGS. 14 through 18, the air flow inlet aperture side wall (19) joining the air flow inlet plate top and bottom (12)(18), can but need not necessarily, be at an angle of about ninety degrees (90°) or at 90°. As to particular embodiments, the air flow inlet aperture elements (17) can, but need not necessarily, include an air flow inlet aperture side wall (19) which joins the air flow inlet plate top and bottom (12)(18) at an angle of greater or lesser than 90°. As shown in the illustrative example of FIG. 18, the angle can be between about 70° and about 90° in relation to one or both of the air flow inlet plate top and bottom surfaces (12)(18) or, as to particular embodiments, can be between 90° and 120° in relation to one or both of the air flow inlet plate top and bottom (12)(18). As to particular embodiments, the angle of the air flow inlet aperture side wall (19), can be selected from the group including or consisting of: about 70 degrees to about 80 degrees, about 75 degrees to about 85 degrees, about 80 degrees to about 90 degrees, about 85 degrees to about 95 degrees, about 90 degrees to about 100 degrees, about 95 degrees to about 105 degrees, about 100 degrees to about 110 degrees, about 105 degrees to about 115 degrees, about 110 degrees to about 120 degrees, and combinations thereof.

There can be an advantage in joining the air flow inlet aperture side wall (19) to the air flow inlet plate top or bottom (12)(18) at an angle of lesser than 90° to create an air flow inlet aperture edge (20) which can have increased engagement forces with the material entrainment elements (21) of an implement head (22). Similarly, there can be an advantage in joining the air flow inlet aperture side wall (19) to the air flow inlet plate top or bottom (12)(18) at an angle of greater than 90° to create an air flow inlet aperture edge (20) which can have decreased engagement forces with the material entrainment elements (21) of an implement head (22).

Embodiments of the air flow inlet plate top or bottom (12)(18) can, but need not necessarily, include roughness elements (23) having a controlled profile roughness parameter ("Ra"). For the purposes of this invention the term "Ra"

means the arithmetic average of the absolute values of the profile height deviations of the roughness elements (23) from the mean line, recorded within the evaluation length The air flow inlet plate top or bottom (12)(18) or the base top (3) can have a preselected profile roughness parameter which provides a pre-selected passive resistance to movement of the material entrainment elements (21) of the implement head (22) over the base top (3) or over the air flow inlet plate top or bottom (12)(18) to control the speed at which the material entrainment elements (21) pass over the air flow inlet aperture elements (17). As to particular embodiments, the air flow inlet plate top or bottom (12)(18) can have roughness elements (23) having a profile roughness parameter of less than about 32 Ra. As to particular embodiments, the roughness elements (23) can have the pre-selected profile roughness parameter of the air flow inlet plate top or bottom surfaces (12)(18) selected from the group including or consisting of: about 0 Ra to about 10 Ra, about 5 Ra to about 15 Ra, about 10 Ra to about 20 Ra, about 15 Ra to about 25 Ra, about 20 Ra to about 30 Ra, and about 25 to less than about 32 Ra, and combinations thereof.

Particular embodiments can, but need not necessarily include, roughness elements (23) coupled to the air flow inlet aperture side wall (19). The preselected profile roughness parameter of the roughness elements (23) coupled to the air flow inlet aperture side wall (19) can be between about 250 Ra to about 32 Ra depending on the method used to cut the air flow inlet plate (9) to create the air flow inlet aperture side wall (19). As to particular embodiments, the roughness elements (23) coupled to the air flow inlet aperture side wall (19) can be selected from the group including or consisting of: about 32 Ra to about 60 Ra, about 45 Ra to about 75 Ra, about 60 Ra to about 90 Ra, about 75 Ra to about 105 Ra, about 90 Ra to about 120 Ra, about 105 Ra to about 135 Ra, about 120 Ra to about 150 Ra, about 135 Ra to about 165 Ra, about 150 Ra to about 180 Ra, about 165 Ra to about 195 Ra, about 180 Ra to about 210 Ra, about 195 Ra to about 225 Ra, about 210 Ra to about 240 Ra, and about 225 Ra to about 250 Ra, and combinations thereof.

The lesser the profile roughness parameter (Ra) of the roughness elements (23) coupled to the air flow inlet plate top or bottom (12)(18) or air flow inlet aperture side wall (19), the greater the sharpness of the air flow inlet aperture edge (20). As to particular embodiments, the air flow inlet aperture edge (20), can but need not necessarily be, broken to produce a radius or chamfer of about 0.015 inch or less.

The pre-selected profile roughness of the roughness elements (23) disposed on the air flow inlet plate top or bottom (12)(18) or coupled to the air flow inlet aperture side wall (19) can be achieved through grinding, polishing, lapping, abrasive blasting, honing, electrical discharge machining, milling, lithography, etching, chemical milling, laser texturing, or other similar processes.

Now referring primarily to FIGS. 2, 4 through 6, 12, and 13, as to particular embodiments, the air flow chamber side wall (6) can, but need not necessarily, be configured to provide one or more air flow barrier walls (24A)(24B) to subdivide the air flow chamber (5) into two or more air flow chamber compartments (25). Correspondingly, the air flow inlet aperture elements (17) can be disposed in the air flow inlet plate (9) to provide one or more discrete air flows (26) to each of the two or more air flow chamber compartments (25). As shown by the illustrative example of FIGS. 4 through 6, 12, and 13, the air flow inlet aperture elements (17) can be configured as three linear elongate air flow slots (17A)(17B)(17C), each delivering a discrete air flow (26A)(26B)(26C) to each one of three discrete air flow chamber compartments (25A)(25B)(25C) separated by the first and second barrier walls (24A)(24B). As to particular embodiments, the configuration of the air flow inlet plate (9) allows the air flow inlet plate bottom (18) to be secured to the base top (3), aligning each one of the three linear elongate air flow slots (17A)(17B)(17C) with a corresponding one of the three discrete air flow chamber compartments (25A)(25B)(25C) (as shown in the example of FIG. 4), providing a first air flow orientation (27) of the air flow inlet plate (9), and allows the air flow inlet plate (9) to be turned over engaging the air flow inlet plate top (12) with the base top (3) to align only the first linear elongate air flow slot (17A) and the third linear elongate air flow slot (17C) with the first air flow chamber compartment (25A) and the third air flow chamber compartment (25C), providing a second air flow orientation (28) of the air flow inlet plate (9) (as shown in FIG. 5). The second linear elongate air flow slot (17B) overlies an air flow barrier wall top (29) to reduce or close the associated air flow inlet open area (30), thereby correspondingly reducing or interrupting the second air flow (26B) to the second air flow chamber compartment (25B). The first and second air flow orientation (27)(28) of the air flow inlet plate (9) can provide one or more advantages including: conforming the air flow (26) more closely to the configuration of the material entrainment elements (21) or the implement head (22), or generating an air flow (26) having a lesser velocity through a greater air flow inlet open area (30), or generating an air flow (26) having a greater velocity through a lesser air flow inlet open area (30).

Now referring primarily to FIGS. 2 through 6 and FIGS. 19 through 24, an air flow outlet element (31) can be coupled to the base (2). The air flow outlet element (31) can have an internal surface (32), which defines an air flow outlet passage (33), which allows egress of the air flow (26) passing into the air flow chamber (5). Particular embodiments, can, but need not necessarily include, an air flow outlet plate (34) disposed over the air flow chamber (5) to provide one or more air outlet aperture elements (35) communicating between an air flow outlet plate top (34A), and an air flow outlet plate bottom (34B) defining an air outlet aperture open area (36) through which the air flow (26) egresses from the air flow chamber (5). As to particular embodiments, the air flow outlet plate (34) and the air flow inlet plate (9) can be made as one piece configured to be turned over to regulate the air flow (26) to the air flow chamber (5), as above described.

Now referring primarily to FIGS. 2 through 6, embodiments can, but need not necessarily include, an air flow conduit coupler (37) having an air flow conduit coupler body (38) disposed between an air flow conduit coupler first end (39) and an air flow conduit coupler second end (40). The air flow conduit coupler first end (39) can be sealably coupled or sufficiently sealably coupled to the air flow outlet plate (34) to allow an air flow (26) to be drawn through the air flow chamber (5).

Now referring primarily to FIGS. 2 through 6 and 25 through 28, as to particular embodiments, the air flow conduit coupler body (38) can, but need not necessarily include, a cylindrical neck (41) between the air flow conduit coupler first end (39) and the air flow conduit coupler second end (40). The cylindrical neck (41) can include a neck aperture (42) through which air flow (26) can pass through the air flow conduit coupler (37). The neck aperture (42) can face toward and above the air flow inlet plate (9) covering the air flow chamber (5).

An air flow control element (43) can, but need not necessarily be, coupled to the air flow conduit coupler (37)

to adjustably control the air flow through the neck aperture (42). As to particular embodiments, the air flow control element (43) can include a cylindrical body (44) having an air flow control aperture (45) which communicates between an air flow control element internal surface (46) and an air flow control external surface (47). The air flow control element internal surface (46) can be rotatingly engaged about the neck element (48) to allow the air flow control aperture (45) to align with the neck aperture (42) to control the amount of air flow (26) passing through the neck aperture (42). As to particular embodiments, the air flow control element (43) can comprise a radially slotted annular body (49) defining a radial slot (50) disposed between a pair of cylindrical body ends (51).

The air flow conduit coupler body (38) can be further configured to allow sealable coupling to an air flow conduit first end (52). As to particular embodiments, the air flow conduit coupler body (38) can include a head element (53) coupled to the neck element (48). The head element (53) can taper inwardly approaching the air flow conduit coupler second end (40) to allow various diameters of air flow conduit first end (52) to be coupled, connected or frictionally engaged with the air flow conduit coupler body (38).

Now referring primarily to FIGS. 2, 6, 7, and 29, embodiments of the base (2) can, but need not necessarily, include a vacuum chamber (54) disposed in the base bottom (4) configured for placement on a support surface (55). A vacuum chamber side wall (56) connects a vacuum chamber top (57) to the base bottom (4) defining a vacuum chamber periphery (58) and a vacuum chamber opening (59). The air flow outlet passage (33) can be fluidicly coupled to the vacuum chamber (54) to generate an air flow (26) through the vacuum chamber opening (59).

Figure 29:
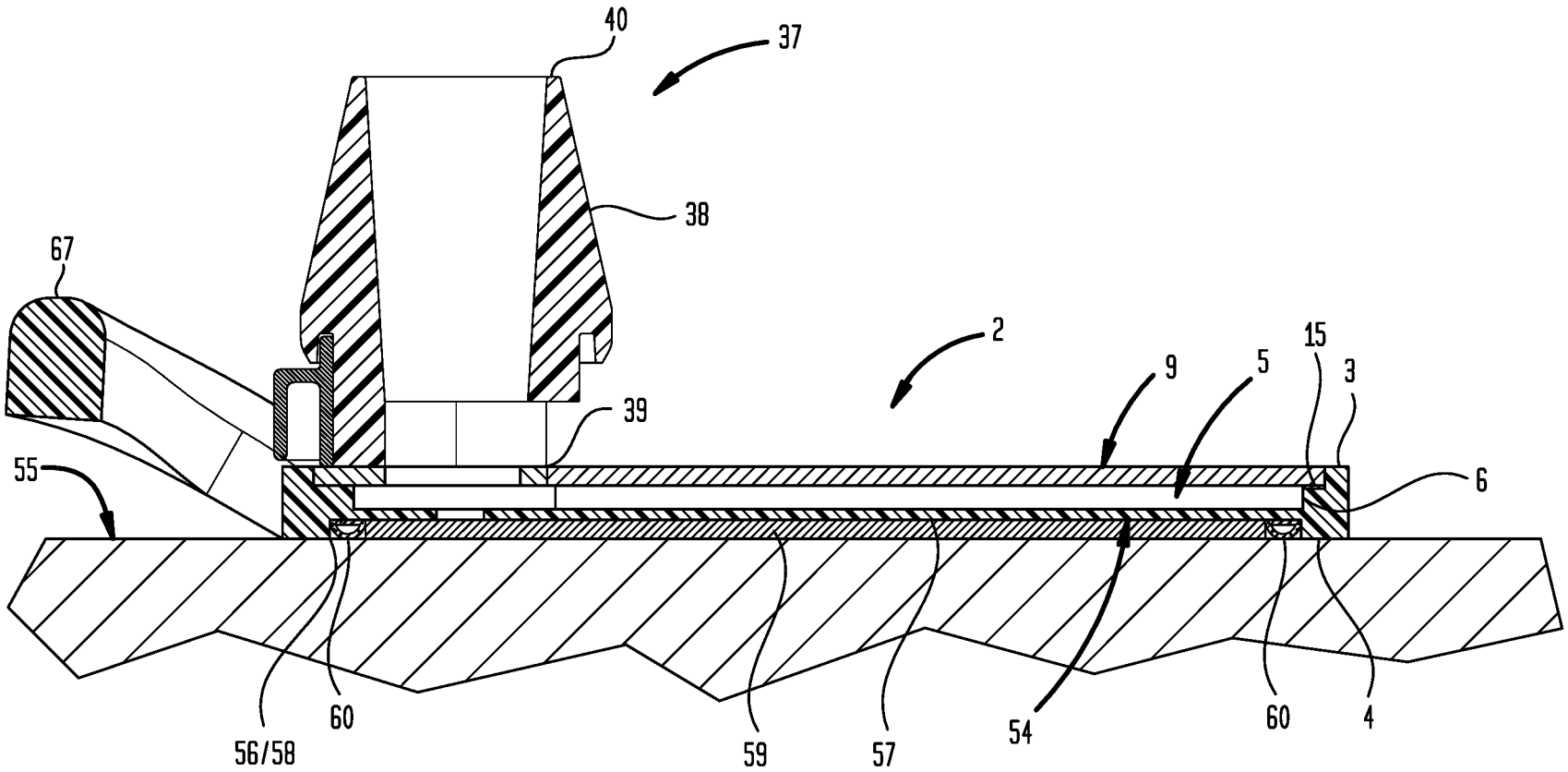
FIG. 29 is a cross section view of 29-29 as shown in FIG. 4 of a particular embodiment of the implement head cleaner.

As to particular embodiments, a vacuum chamber periphery seal (60) can, but need not necessarily, be disposed about the vacuum chamber periphery (58). The vacuum chamber periphery seal (60) can be configured to sealably engage the support surface (55) to interrupt or reduce the air flow (26) passing through the vacuum chamber opening (59) to generate a vacuum in the vacuum chamber (54) (air pressure within the vacuum chamber (54) being less than ambient atmospheric pressure) sufficient to prevent or reduce movement of the base (2) on the support surface (55) during normal use. The vacuum chamber periphery seal (60) disposed about the vacuum chamber periphery (58) may extend a distance outward of the base bottom (4) such that upon engagement of the vacuum chamber periphery seal (60) with the support surface (55) the first and second inclined elements (61)(64) may be disposed a distance above the support surface (55). The vacuum chamber periphery seal (60) can be compressed during generation of the vacuum in the vacuum chamber (54), thereby drawing the base bottom (4) toward the support surface (55) to dispose the first and second inclined elements (61)(64) proximate or in contact with the support surface (55). While the example of FIG. 29 depicts the vacuum chamber periphery seal (60) as a hollow elastomeric tube collapsible in response to a vacuum within the vacuum chamber (54), the vacuum chamber periphery seal (60) can be produced from a wide variety of substantially rigid, compressible or collapsible materials, whether as a solid or a hollow structure, depending upon the application, which can sealably engage a support surface (55) to allow generation of a vacuum within the vacuum chamber (54), such as, an open or closed cell foam, elastic polymers, natural or synthetic rubber, or the like. As to particular embodiments, the base (2) and the vacuum chamber periphery seal (60) may be one piece.

Figure 7:
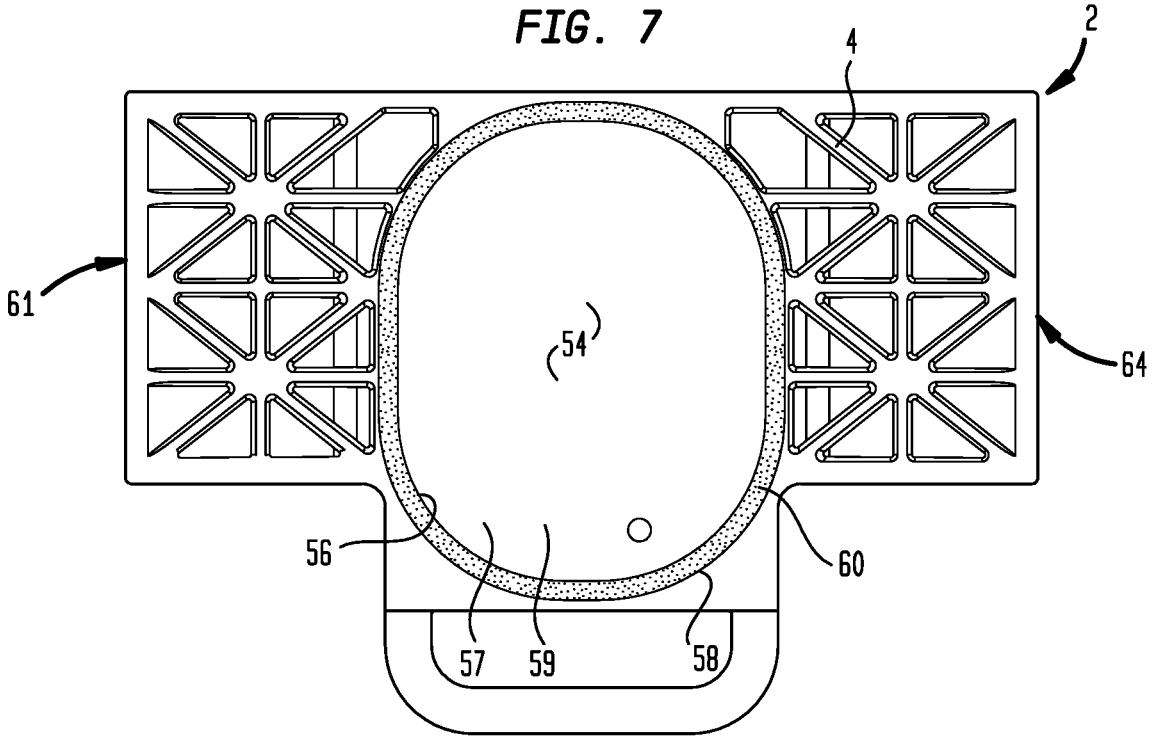
FIG. 7 is a bottom plan view of a particular embodiment of the implement head cleaner having a vacuum chamber and vacuum chamber seal.
Figure 8:
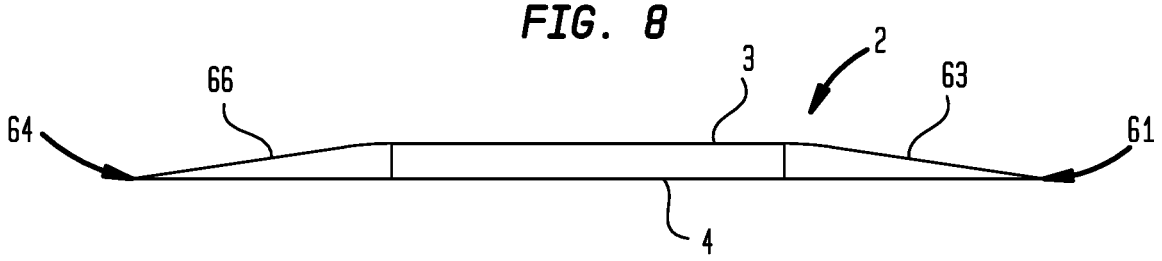
FIG. 8 is a back elevation view of a particular embodiment of the implement head cleaner.
Figure 9:
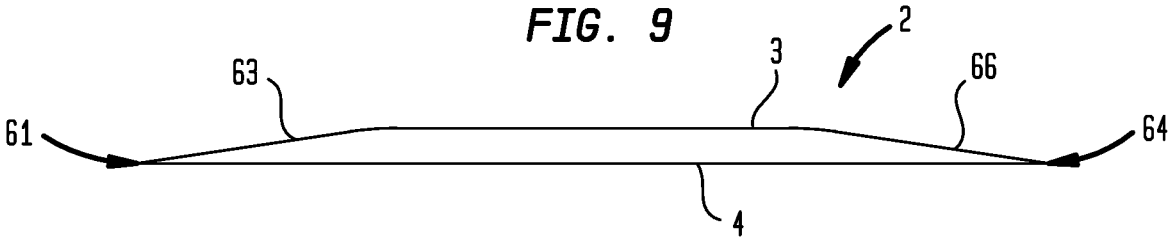
FIG. 9 is a front elevation view of a particular embodiment of the implement head cleaner.
Figure 10:
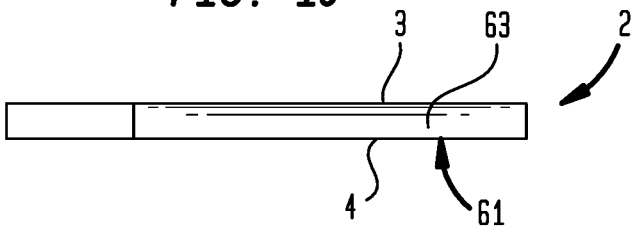
FIG. 10 is a first end elevation view of a particular embodiment of the implement head cleaner.
Figure 11:
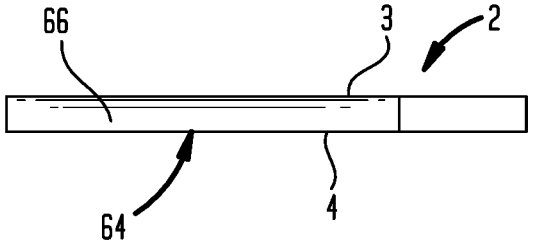
FIG. 11 is a second end elevation view of a particular embodiment of the implement head cleaner.
Figure 12:
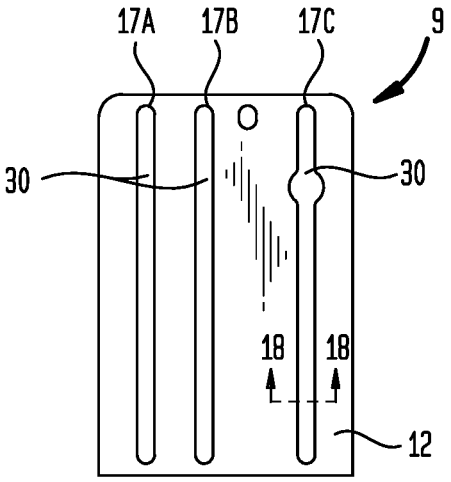
FIG. 12 is a top plan view of a particular embodiment of the air flow inlet plate.
Figure 13:
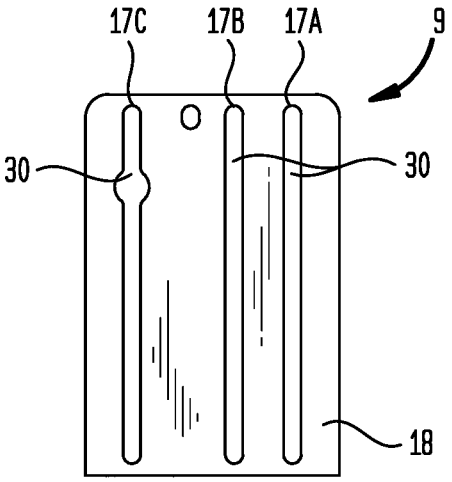
FIG. 13 is a bottom plan view of a particular embodiment of the air flow inlet plate.
Figure 17:
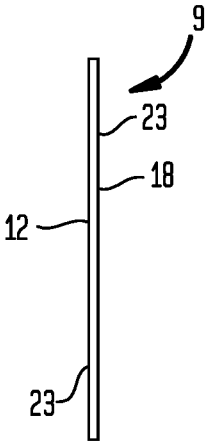
FIG. 17 is a second side elevation view of a particular embodiment of the air flow inlet plate.
Figure 14:
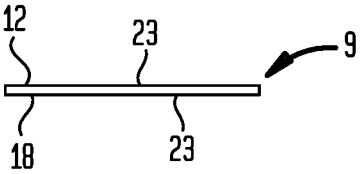
FIG. 14 is a first end elevation view of a particular embodiment of the air flow inlet plate.
Figure 15:
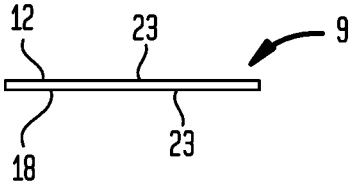
FIG. 15 is a second end elevation view of a particular embodiment of the air flow inlet plate.
Figure 16:
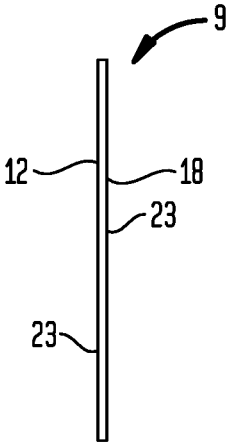
FIG. 16 is a first side elevation view of a particular embodiment of the air flow inlet plate.
Figure 18:
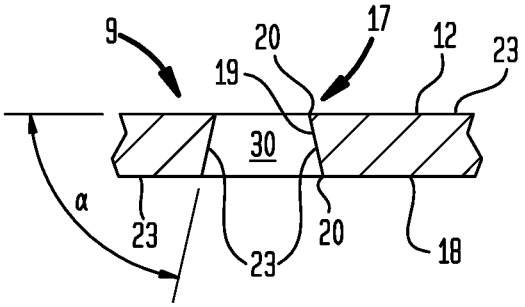
FIG. 18 is a cross section view of 18-18 of the air flow inlet plate as shown in FIG. 12.
Figure 19:
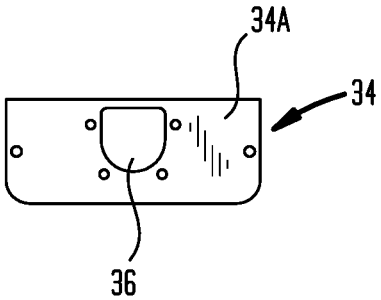
FIG. 19 is a top plan view of a particular embodiment of the air flow outlet plate.
Figure 20:
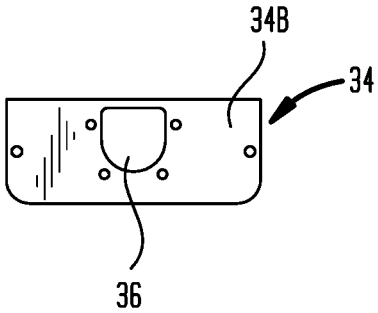
FIG. 20 is a bottom plan view of a particular embodiment of the air flow outlet plate.
Figure 22:
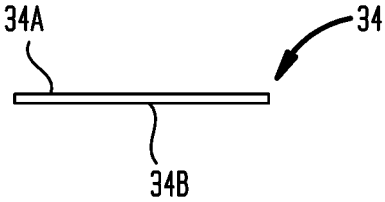
FIG. 22 is a second side elevation view of a particular embodiment of the air flow outlet plate.
Figure 24:
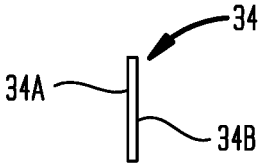
FIG. 24 is a second end elevation view of a particular embodiment of the air flow outlet plate.
Figure 21:
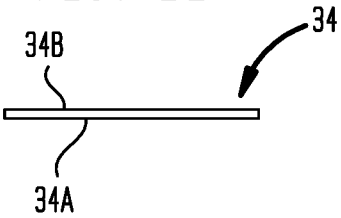
FIG. 21 is a first side elevation view of a particular embodiment of the air flow outlet plate.
Figure 23:
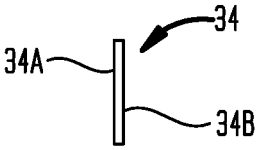
FIG. 23 is a first end elevation view of a particular embodiment of the air flow outlet plate.
Figure 25:
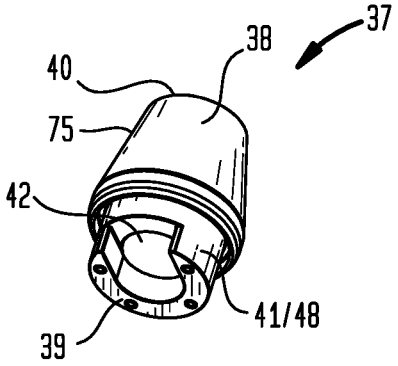
FIG. 25 is a perspective view of a particular embodiment of an air flow outlet.
Figure 26:
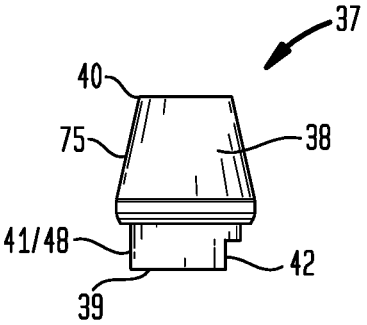
FIG. 26 is an elevation view of a particular embodiment of an air flow outlet.
Figure 27:
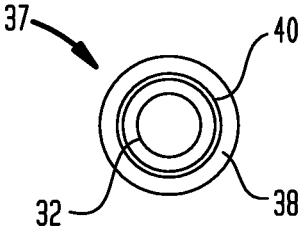
FIG. 27 is a top plan view of a particular embodiment of an air flow outlet.
Figure 28:
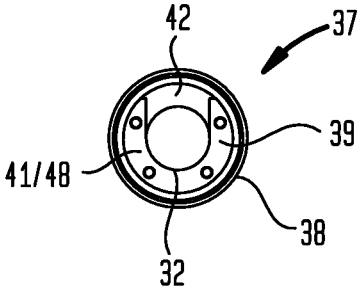
FIG. 28 is a bottom plan view of a particular embodiment of an air flow outlet.

Now referring primarily to FIGS. 1 through 5, and 7 through 11, embodiments of the base (2) can, but need not necessarily, include a first inclined element (61) connected to a first side (62) of the base (2). The first inclined element defines a first inclined surface (63) disposed between the base bottom (4) and the base top (3) affording a first inclined surface (63) between about the elevation of the support surface (55) and the elevation of base top (3) (as shown by the examples of FIGS. 1 and 4). Embodiments of the base (2) can, but need not necessarily, include a second inclined element (64) connected to a second side (65) of the base. The second inclined element (64) defines a second inclined surface (66) disposed between the base bottom (4) and the base top (3) affording a second inclined surface (66) between about the elevation of the support surface (55) and the elevation of base top (3). The configuration of the first inclined element (61) or the second inclined element (64) can be substantially similar as shown in the example of FIG. 4, or can be substantially dissimilar to facilitate slidable engagement with different configurations of material entrainment elements (21) of implement heads (22). The first and second inclined elements (61)(64) can, but need not necessarily, be releasably detachable from the base (2), or the base (2) and the first and second inclined elements (61)(64) can be one piece. While FIG. 7 depicts a structural pattern on the base bottom (4) and the first and second inclined elements (61)(64), the structural pattern is not meant to be limiting with respect to the structure of the base bottom or the first and second inclined elements (61)(64). The structural pattern shown or similar structural patterns may be used to reduce the amount of material used in production of the base (2) or the first and second inclined elements (61)(64), or to avoid warping of the base (2) or the first and second inclined elements (61)(64) during fabrication or molding processes.

Figure 3:
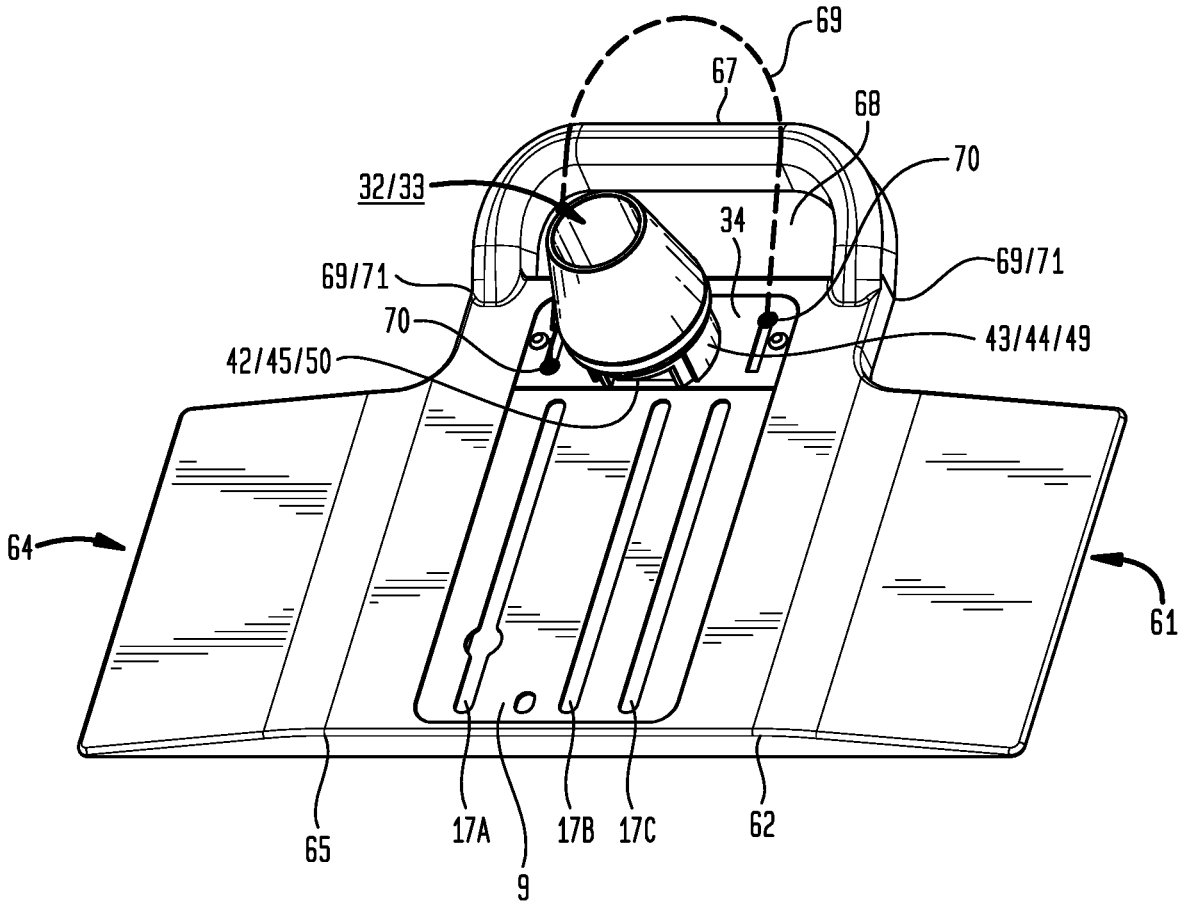
FIG. 3 is a top front perspective view of an embodiment of the inventive implement head cleaner showing the air flow conduit coupler and alignment of the neck aperture and air flow control aperture.

As to particular embodiments, the implement head cleaner (1) can, but need not necessarily, include a handle (67) grippable to carry the implement head cleaner (1). As shown in the illustrative example of FIG. 3, the handle (67) and the base (2) can be formed in one piece with the handle (67) extending from the base (2) to provide a configuration grippable by a portion of the hand located in a pass-through aperture (68). As to particular embodiments, the handle (67) can be disposed at an angle in relation to the base top (3) or the base bottom (4) to maintain the pass-through aperture (68) open on opposed sides of the handle (67), to permit location of the hand in the pass-through aperture (68) with the base bottom (4) engaged with the support surface (55). As to other embodiments, the handle element (69) can be provided as a line, cable, cord or the like, having a length disposed between a pair of handle fastener elements (70). Each opposed end portion of the handle element (69A)(69B) can be secured to a corresponding one of a pair of handle slots (71) disposed in opposed sides of the air flow outlet plate (34) (as shown in the example of FIGS. 2 and 3 in broken line).

Now referring primarily to FIG. 1, embodiments can, but need not necessarily, include an air flow conduit (72) having a length disposed between an air flow conduit first end (52) and an air flow conduit second end (73). The air flow conduit (72) will generally be a vacuum hose having an internal diameter of between about 1 inch and about 3 inches, and having a length sufficient to generate an air flow (26) between the air flow outlet plate (34) and an air flow generator (74).

Now referring primarily to FIG. 1, embodiments can, but need not necessarily, include an air flow generator (74)

capable of generating an air flow (26) measured in cubic feet per minute ("CFM") through the plurality of air flow inlet aperture elements (17). Typically, the air flow generator (74) can generate an air flow (26) of between about 100 CFM and about 1000 CFM, although a lesser or greater air flow (26) can be generated depending on the application.

Now referring primarily to FIG. 1, which illustrates a method of using a particular embodiment of the inventive implement head cleaner (1) including: obtaining an implement head cleaner (1) having: a base (2) having an air flow chamber (5) disposed in a base top (3) and having a vacuum chamber (54) disposed in a base bottom (4) configured for placement on a support surface (55), an air flow inlet plate (9) coupled to the air flow chamber (5) to direct an air flow (26) through an air flow inlet open area (30) of one or more air flow inlet aperture elements (17) which communicate between an air flow inlet plate top and an air flow inlet plate bottom (12)(18) of the air flow inlet plate (9), an air flow outlet plate (34) coupled to the air flow chamber (5) to direct the air flow (9) through an air outlet aperture open area (36), and an air flow generator (74) fluidicly coupled to the air flow chamber (5) and vacuum chamber (54) which generates the air flow (26).

By generating an air flow through the implement head cleaner (1) by operation of the air flow generator (74), an air flow (26) passes through the air flow inlet aperture elements (17) of the air flow inlet plate (9) into the air flow chamber (5), and egresses the air flow chamber (5) through the air outlet aperture open area (36) of the air flow outlet plate (34). As air flow (26) passes through the air flow inlet plate (9), the material entrainment elements (21) of an implement head (22) of an implement (75) can be passed through the air flow to transfer an amount of material entrained (76) from the material entrainment elements (21) of the implement head (22) to the air flow passing through the air flow inlet aperture elements (17).

The term "implement" for the purposes of this invention means any tool, utensil, or piece of equipment which includes an implement head, hand-held or otherwise.

The term "implement head" for the purposes of this invention means that portion of an implement which directly or indirectly carries, receives, couples, attaches, or any combination thereof, to one or more material entrainment elements.

The term "material entrainment elements" for the purposes of this invention means a material capable of entraining material and without reducing the breadth of the foregoing can be one or plurality of: a sponge(s), a pad(s), a sheet(s), a string(s), a fiber(s), a bristle(s), or the like, or combinations thereof.

The method can further include engaging the air flow inlet plate bottom (18) with the base top (3) in a first air flow orientation (27) in which the air flow inlet aperture elements (17) correspondingly align with two or more air flow chamber compartments (25A)(25B)(25C) of the air flow chamber (5) to direct said air flow into each of said two or more air flow chamber compartments (25A)(25B)(25C).

The method can further include engaging the air flow inlet plate top (12) with the base top (3) in a second air flow orientation (28) in which the air flow inlet aperture elements (17) do not correspondingly align with each of the two or more air flow chamber compartments (25A)(25B)(25C). Rather, one or more of the air flow inlet aperture elements (17) in the second air flow orientation (28) can be disposed over one or more air flow barrier walls (24), thereby decreasing the air flow inlet open area (30) in comparison to the air flow inlet open area (30) of the first air flow orientation (27).

This method of using the implement head cleaner (1) can further include moving the material entrainment elements (21) over the air flow inlet plate (9) to overcome the passive resistance of the roughness elements (23) coupled to the air flow inlet plate (9). By altering the pre-selected profile roughness of the air flow inlet plate top (12), air flow inlet plate bottom (18), the air flow inlet aperture side wall (19), or any combination thereof, through the addition or deletion of roughness elements (23) from these respective surfaces, the passive resistance to movement of the material entrainment elements (21) over the air flow inlet plate (9) can be increased or decreased.

The method of using the implement head cleaner (1) can further include passing the air flow through an air flow outlet plate (34) covering the air flow chamber (5). The air flow is then passed through an air flow conduit coupler (37), which has a cylindrical neck (41) between the air flow conduit coupler first end (39) and the air flow conduit coupler second end (40). The cylindrical neck (41) has a neck aperture (42) through which air flow (26) can pass into the air flow conduit coupler (37). An air flow control element (43), shaped to fit around the circumference of the cylindrical neck (41), where the air flow control element (43) has an air flow control aperture (45), is connected to the air flow conduit coupler body (38). The air flow control element (43) can be rotated about the cylindrical neck (41) to align the neck aperture (63) with the air flow control aperture (45), in order to increase or decrease the air flow (26) egressing from the air flow chamber (5) through the air flow outlet plate (34) or the air flow (26) entering air flow conduit coupler (37) through the neck aperture (63).

The method can further include moving the material entrainment elements (21) adjacent to the neck aperture (42) such that the material entrainment elements (21) at the periphery of the implement head (22) pass through the air flow (26) entering the neck aperture (42). As to these embodiments the material entrainment elements can pass primarily through the air flow (26) entering the neck aperture (42), primarily the air flow (26) entering the air flow inlet aperture elements (17), or currently through both air flows (26) depending upon the application.

The method of using the implement head cleaner (1) can further include connecting a first inclined element (61) or a second inclined element (64), or both, to the base (2), and moving the material entrainment elements (21) over the first inclined element, the second inclined element, or both (61)(64). The first inclined element and second inclined element (61)(64) can each define an inclined surface between the support surface (55) and base top (3). If both a first inclined element and second inclined element (61)(64) are coupled to the base (2), they can be attached in opposed relation to the base first side (62) and the base second side (65) of the base (2). As to embodiments having only a first inclined element (61), the material entrainment elements (21) can be slidably engaged to the first inclined surface (63), moved over the first inclined surface (63) in a direction toward the base first side (62) of the base (2), and by continuing to slidably move the material entrainment elements (21) over the air flow inlet plate (9) the material entrainment elements (21) can be passed through the air flow (26) entering the air flow inlet aperture elements (17). As to embodiments having a first inclined element and a second inclined element (61)(64), the material entrainment elements (21) can be slidably engaged to the first inclined element surface (63), moved over the first inclined surface (63) in a direction toward the base first side (62) of the base (2), continuing to slidably move the material entrainment elements (21) over the air flow inlet plate (9), the material entrainment elements (21) can be passed through the air flow (26) entering the air flow inlet aperture elements (17), and then continuing to slidably move the material entrainment elements (21) over the second inclined surface (66) in a direction away from the base second side (65) of the base (2). The movement of the material entrainment elements (21) can be reversed reciprocally in relation to the base (2) to repeatedly engage the material entrainment elements (21) with the air flow (26) entering the air flow inlet aperture elements (17) or entering the neck aperture (42).

As can be easily understood from the foregoing, the basic concepts of the present invention may be embodied in a variety of ways. The invention involves numerous and varied embodiments of an implement head cleaner and methods for making and using such implement head cleaner including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of an "air flow generator" should be understood to encompass disclosure of the act of "generating an air flow"—whether explicitly discussed or not—and, conversely, were there effectively disclosure of the act of "generating an air flow", such a disclosure should be understood to encompass disclosure of a "an air flow generator" and even a "means for generating an air flow." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the implement head cleaners herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. An apparatus, comprising:

a base having a base top and a base bottom;

an air flow chamber disposed in said base top;

one or more air flow barrier walls disposed inside of said air flow chamber;

an air flow inlet plate engagable with said base top to cover said air flow chamber; and a plurality of air flow inlet aperture elements disposed in said air flow inlet plate and fluidicly coupled to said air flow chamber;

wherein said air flow inlet plate engages with said base top to provide (i) a first air flow orientation and (ii) a second air flow orientation which differs from said first air flow orientation;

wherein in said second air flow orientation, an air flow inlet open area is decreased in comparison to said first air flow orientation.

2. The apparatus of claim 1, wherein said air flow barrier walls divide said air flow chamber into two or more air flow chamber compartments.

3. The apparatus of claim 2, wherein said air flow inlet aperture elements have a location in said air flow inlet plate in said first air flow orientation to correspondingly align with said air flow chamber compartments when said air flow inlet plate engages with said base top.

4. The apparatus of claim 3, wherein said air flow inlet aperture elements have a location in said air flow inlet plate in said second air flow orientation to align at least one of said air flow inlet aperture elements with at least one of said air flow barrier walls when said air flow inlet plate engages with said base top.

5. The apparatus of claim 1, wherein said air flow inlet aperture elements comprise a plurality of linear elongate slots disposed in substantially parallel spaced apart relation in said air flow inlet plate.

6. The apparatus of claim 1, further comprising roughness elements disposed on an air flow inlet plate top or an air flow inlet plate bottom.

7. The apparatus of claim 1, wherein each said air flow inlet aperture element has an air flow inlet aperture side wall connecting an air flow inlet plate top and an air flow inlet plate bottom;

further comprising roughness elements disposed on said air flow inlet aperture side wall.

8. The apparatus of claim 7, wherein said air flow inlet aperture side wall has an angular position of between about 70 degrees and about 120 degrees in relation to said air flow inlet plate top.

9. The apparatus of claim 1, wherein one or more fasteners secure said air flow inlet plate to said base top.

10. The apparatus of claim 1, further comprising an air flow outlet element having an internal surface which defines an air flow outlet passage fluidicly coupled to said air flow chamber.

11. The apparatus of claim 10, wherein said air flow outlet element includes an air flow outlet plate which engages said base top to cover said air flow chamber, said air flow outlet plate having an air flow outlet aperture element through which air flow egresses from said air flow chamber.

12. The apparatus of claim 11, further comprising an air flow conduit coupler having an air flow conduit coupler body disposed between an air flow conduit coupler first end and an air flow conduit coupler second end, said air flow conduit coupler first end sealably coupled to said air flow outlet plate, said air flow conduit coupler second end adapted to sealably engage an air flow conduit disposable between said air flow conduit coupler and an air flow generator.

13. The apparatus of claim 12, wherein said air flow conduit coupler further comprises a cylindrical neck disposed between said air flow conduit coupler first end and said air flow conduit coupler second end, said cylindrical neck having a neck aperture through which said air flow passes into said air flow conduit coupler, said neck aperture facing toward and above said air flow inlet plate covering said air flow chamber.

14. The apparatus of claim 13, further comprising an air flow control element coupled to said air flow conduit coupler, said air flow control element adjustable to control said air flow through said neck aperture.

15. The apparatus of claim 14, wherein said air flow control element comprises a cylindrical body having an air flow control aperture which communicates between an air flow control element internal surface and an air flow control element external surface, said air flow control element internal surface rotatingly engaged about said cylindrical neck to allow said air flow control aperture to align with said neck aperture to control said air flow passing through said neck aperture.

16. The apparatus of claim 15, wherein said air flow control element comprises a radially slotted annular body defining a radial slot disposed between a pair of cylindrical body ends.

17. The apparatus of claim 13, wherein said air flow conduit coupler further comprises a head element connected to said cylindrical neck, said head element having a head element external surface which tapers inwardly approaching said air flow conduit coupler second end.

18. The apparatus of claim 10, further comprising a vacuum chamber disposed in said base bottom, said vacuum chamber including a vacuum chamber periphery defining a vacuum chamber opening at said base bottom, said vacuum chamber fluidicly coupled with said air flow outlet passage.

19. The apparatus of claim 18, further comprising a vacuum chamber seal coupled to said base bottom about said vacuum chamber periphery.

20. The apparatus of claim 19, further comprising:

a first inclined element connected to a first side of said base defining a first inclined surface between said base top and said base bottom; and a second inclined element connected to a second side of said base defining a second inclined surface between said base top and said base bottom.

21. An apparatus, comprising:

a base having a base top and a base bottom;

an air flow chamber disposed in said base top;

one or more air flow barrier walls disposed inside of said air flow chamber;

an air flow inlet plate engagable with said base top to cover said air flow chamber; and a plurality of air flow inlet aperture elements disposed in said air flow inlet plate and fluidicly coupled to said air flow chamber;

wherein said air flow inlet plate engages with said base top to provide (i) a first air flow orientation and (ii) a second air flow orientation which differs from said first air flow orientation;

wherein said air flow barrier walls divide said air flow chamber into two or more air flow chamber compartments;

wherein said air flow inlet aperture elements have a location in said air flow inlet plate in said first air flow orientation to correspondingly align with said air flow chamber compartments when said air flow inlet plate engages with said base top; and wherein said air flow inlet aperture elements have a location in said air flow inlet plate in said second air flow orientation to align at least one of said air flow inlet aperture elements with at least one of said air flow barrier walls when said air flow inlet plate engages with said base top.

* * * * *